US007690649B2

(12) United States Patent
Davies et al.

(10) Patent No.: US 7,690,649 B2
(45) Date of Patent: Apr. 6, 2010

(54) METHOD FOR DETECTING PAPER FEED SHINGLING ERRORS AND SYNCHRONIZING A PRINTER AND A FEEDER

(75) Inventors: Brad L. Davies, Derby, CT (US); Keith M. Smith, Fairfield, CT (US); Wesley A. Kirschner, Farmington, CT (US); Elaine B. Cristiani, Stratford, CT (US); Gary S. Jacobson, Norwalk, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 12/128,853

(22) Filed: May 29, 2008

(65) Prior Publication Data

US 2009/0020946 A1 Jan. 22, 2009

Related U.S. Application Data

(60) Provisional application No. 60/950,617, filed on Jul. 19, 2007.

(51) Int. Cl.
*B65H 7/02* (2006.01)

(52) U.S. Cl. ..... 271/259; 271/258.01; 271/258.02

(58) Field of Classification Search ..... 271/258.01, 271/265.01, 265.02, 265.04, 262, 263, 259
See application file for complete search history.

(56) References Cited

U.S. PATENT DOCUMENTS

| | | | | |
|---|---|---|---|---|
| 4,521,102 | A * | 6/1985 | Motomura et al. | 399/19 |
| 5,505,440 | A * | 4/1996 | Uematsu | 271/258.01 |
| 6,082,731 | A * | 7/2000 | Yamazaki | 271/240 |
| 2006/0017216 | A1 * | 1/2006 | Mitsuya et al. | 271/121 |
| 2006/0186594 | A1 * | 8/2006 | Mitsuya et al. | 271/262 |

* cited by examiner

*Primary Examiner*—Patrick H Mackey
*Assistant Examiner*—Ernesto Suarez
(74) *Attorney, Agent, or Firm*—Ronald Reichman; Angelo N. Chaclas

(57) ABSTRACT

A method of synchronizing the feeding and printing of sheets of media, i.e., paper, envelopes, post cards, etc. even though shingled feeds have occurred in the system. The foregoing is accomplished by utilizing two sensors and counters to monitor two sheets of paper to allow two software tasks to stay in synchronization and release the appropriate print data to the printer even when a sheet of paper was not detected in the feeder appears at the print head. The feeder sensor has a counter for its Lead Edge as does the Start of Print Sensor that is in the system's transport paper path. The feeder sensor counter and the start of print counter are incremented and decremented as the paper approaches the sensor and leaves the sensor. If the lead edge counter of the feeder sensor goes negative, then the feeder has shingled and the data for that sheet of paper must be printed.

10 Claims, 3 Drawing Sheets

METHOD FOR DETECTING PAPER FEED SHINGLING ERRORS AND SYNCHRONIZING A PRINTER AND A FEEDER

This Application claims the benefit of the filing date of U.S. Provisional Application No. 60/950,617 filed Jul. 19, 2007, which is owned by the assignee of the present Application.

FIELD OF THE INVENTION

The invention relates generally methods for paper handling, and more particularly to, a method for synchronizing the feeding of paper.

BACKGROUND OF THE INVENTION

The processing and handling of paper sheets to form documents consumes an enormous amount of human and financial resources, for large as well as small organizations. In view of the above, various paper-handling machines have been developed. In known paper-handling machines that separate and transport individual pieces of paper from a stack of paper sheets, the stack of paper sheets is first loaded onto some type of conveying system for subsequent processing. The stack of paper sheets is advanced as a stack or by individual paper sheets in the stack.

In such a paper-handling machine, the various forces acting on the sheets of paper in advancing the stack downstream often act counterproductively relative to each other. For example, inter-sheets of paper stack forces exist between each of the sheets of paper that are in contact with each other in the stack. These inter- sheets of paper forces created by the stack advance mechanism, the frictional forces between the sheets of paper, and electrostatic forces that may exist between sheets of paper, tend to oppose the force required to shear the lead sheet of paper from the stack.

A condition called shingling occurs with paper feeders where the leading edge of one piece of media slips under the trailing edge of the media before it is in a feeder queue. When this occurs, the leading edge of the second piece of media is masked from detection by the feeder sensor, and the feeder monitoring module is likely to miscount the number of pieces of media or paper fed. This, in turn, may lead to loss of synchronization with the printing control module that expects to match a different print page with each and every piece of media fed.

The prior art has attempted to solve the shingling problem by reporting the shingling as an error to the customer. Other prior art solutions simply let the shingled sheet of paper glide through the system without being printed on. In these cases, there is a definite loss of throughput, as well as blank pages in the print stream. Certain less robust systems could actually result in wrong information being printed on the shingled piece.

SUMMARY OF THE INVENTION

This invention overcomes the disadvantages of the prior art by providing a method of synchronizing the feeding and printing of sheets of media, i.e., paper, envelopes, post cards, etc. even though shingled feeds have occurred in the system. The foregoing is accomplished by utilizing two sensors and counters to monitor two sheets of paper to allow two software tasks to stay in synchronization and release the appropriate print data to the printer even when a sheet of paper was not detected in the feeder appears at the print head. The feeder sensor has a counter for its Lead Edge as does the Start of Print Sensor that is in the system's transport paper path. The feeder sensor counter and the start of print counter are incremented and decremented as the paper approaches the sensor and leaves the sensor. If the lead edge counter of the feeder sensor goes negative, then the feeder has shingled and the data for that sheet of paper must be printed. The feeder must also recognize that the lead edge was missed and remove the sheet of paper from its queue so that it can properly detect out of paper or end of job. By executing an algorithm, the machine adapts to the shingled piece and customer throughput is maintained.

An advantage of this invention is that the system does not lose throughput due to processing shingled sheets of paper.

A further advantage of this invention is that blank sheets of paper do not exit the system, so the system does not waste material or end up with a blank envelope or a blank document.

An additional advantage of this invention is that a limited amount of hardware is needed to detect the error condition in the system.

A still further advantage of this invention is that if a specific print is required to be on a specific sheet of paper (i.e.—matching), the specific print will occur despite the shingling error.

A further advantage of this invention is that feeders may be designed at a lower cost since shingling is handled and thus, less mechanical parts are needed to deal with separation.

An additional advantage of this invention is that to provide a unique method of keeping synchronization though shingling has occurred in the system is provided.

DETAILED DESCRIPTION OF THE PRESENT INVENTION

Figure 1:
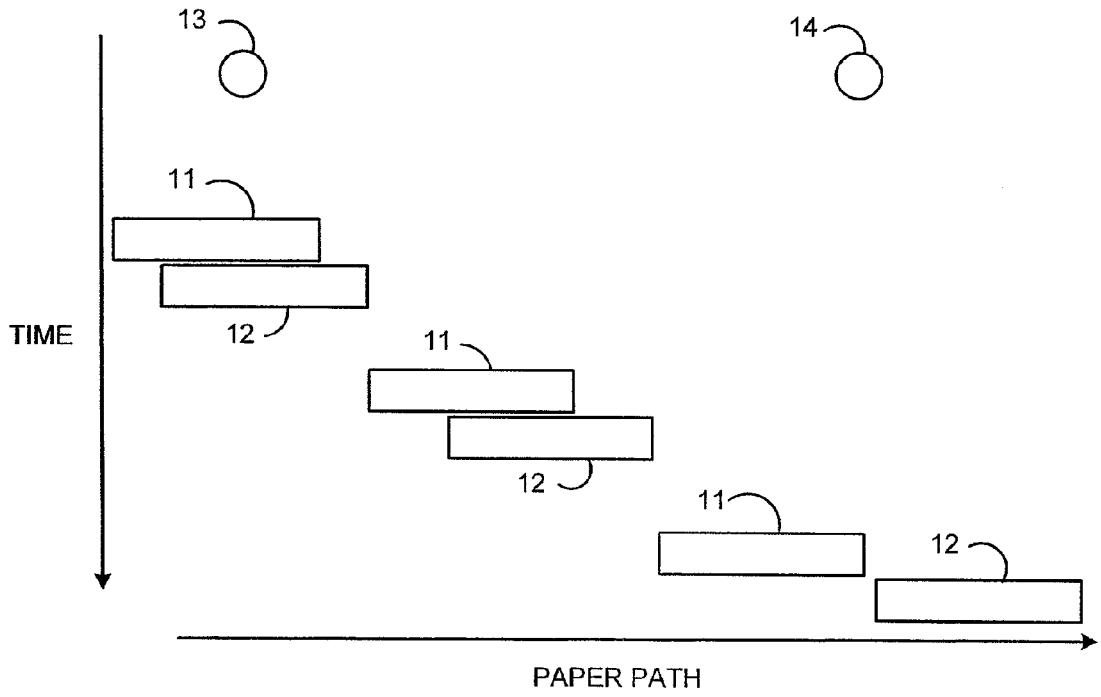
FIG. 1 is a drawing showing sheets of paper passing a feeder sensor and a start of print (SOP) sensor.

Referring now to the drawings in detail and more particularly to FIG. 1, the reference character 11 represents a sheet of paper, envelope, post card, etc. that overlaps sheet of paper, envelope, post card, etc 12 at a given instance in time, as the sheets of paper are being transported along a paper path. Overlapping sheets of paper 11 and 12 are sensed by feeder sensor 13. Feeder sensor 13 indicates sheets of paper 11 and 12 as a single sheet of paper. As time progresses paper sheets 11 and 12 continue to separate along the paper path. When paper sheets 11 and 12 are sensed by start of print sensor 14, paper sheets 11 and 12 should be completely separated and sensor 14 should sense paper sheet 11 being completely separated from paper sheet 12. If the foregoing is true information may be printed on paper sheets 11 and 12. If feeder sensor 13 sensed one sheet of paper and start of print sensor 14 sensed two sheets of paper this invention resynchronizes feeder sensor 13 and start of print sensor 14 so that no sheets of paper will be left blank and information will subsequently be printed on sheets 11 and 12.

Figure 2:
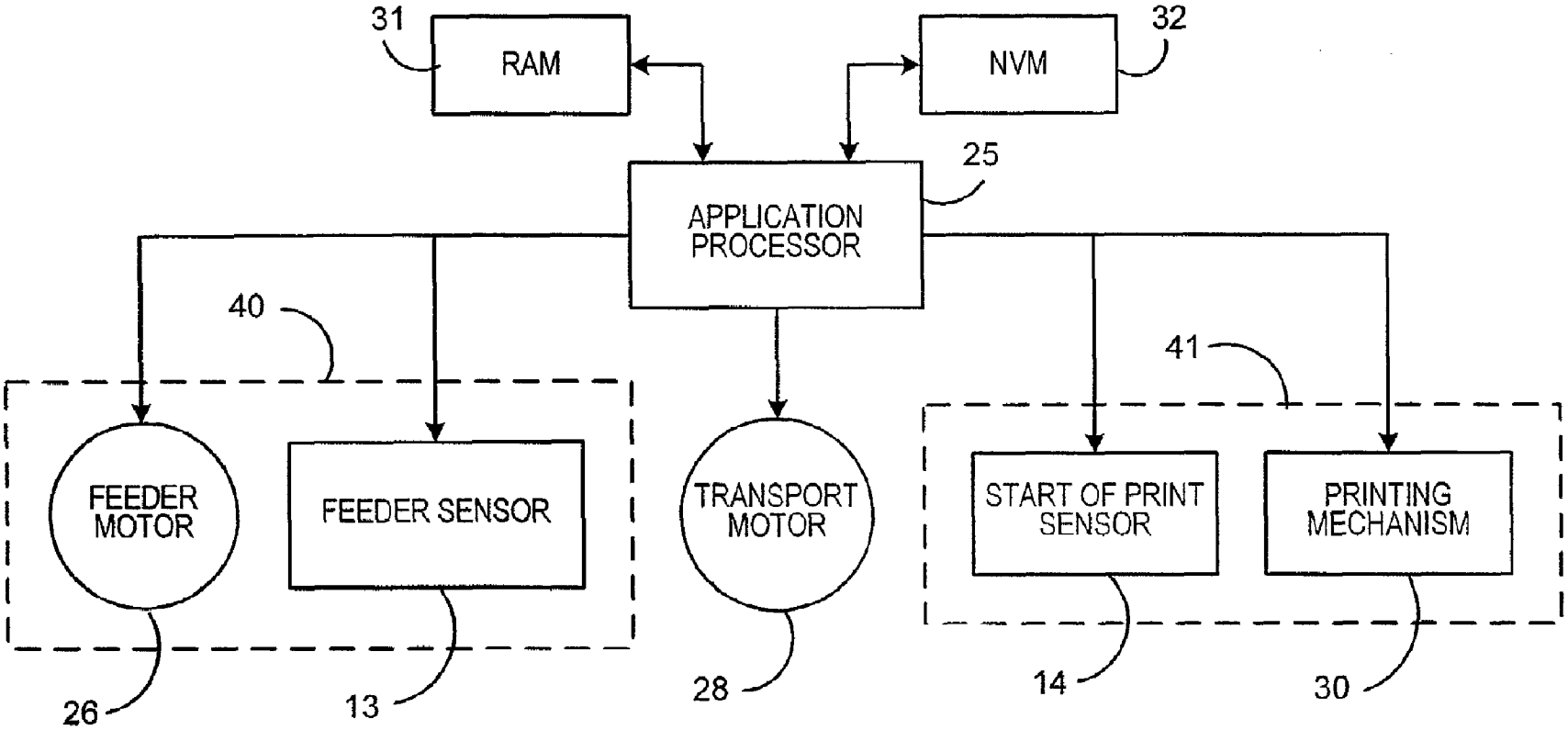
FIG. 2 is a drawing showing the apparatus of this invention.

FIG. 2 is a drawing showing the apparatus of this invention. Application processor 25 is coupled to feeder motor 26 and feeder sensor 13. Feeder module 40 includes motor 26 and feeder sensor 13. Processor 25 is also coupled to transport motor 28, start of print sensor 14, printing module 30, random access memory (RAM 31) and non-volatile memory 32. Transport 41 includes start of print sensor 14 and printing mechanism 30.

Feeder motor 26 drives paper 11 and 12 (FIG. 1) from feeder 40 to transport 41. Feeder sensor 13 detects when paper 11 and 12 is about to exit feeder 40 on the leading edge of paper 11 and 12 and detects when paper 11 and 12 has left the feeder by its trailing edge. Transport motor 28 drives paper 11 and 12 toward printing mechanism 30. Start of print sensor 14 indicates to printing mechanism 30 when printing should commence. Printing mechanism 30 contains control logic (not shown) that interfaces directly with print heads (not shown) to print images on paper 11 and 12 and subsequent sheets of paper as directed by application processor 25 in the order specified by application processor 25. Application processor 25 receives information from sensors 13 and 14 and controls the starting and stopping of motors 26 and 28. In addition application processor 25 controls the order of printing paper 11 and 12 by monitoring the movement of sheets of paper through printing mechanism 30. The Application processor 25 controls the printing and monitors the paper movement in feeder module 40 and transport 41. Random access memory 3contains print buffers (not shown) that are utilized by processor 25. Non-volatile memory 32 is used by processor 25 to store code as well as other parameters.

Figure 3:
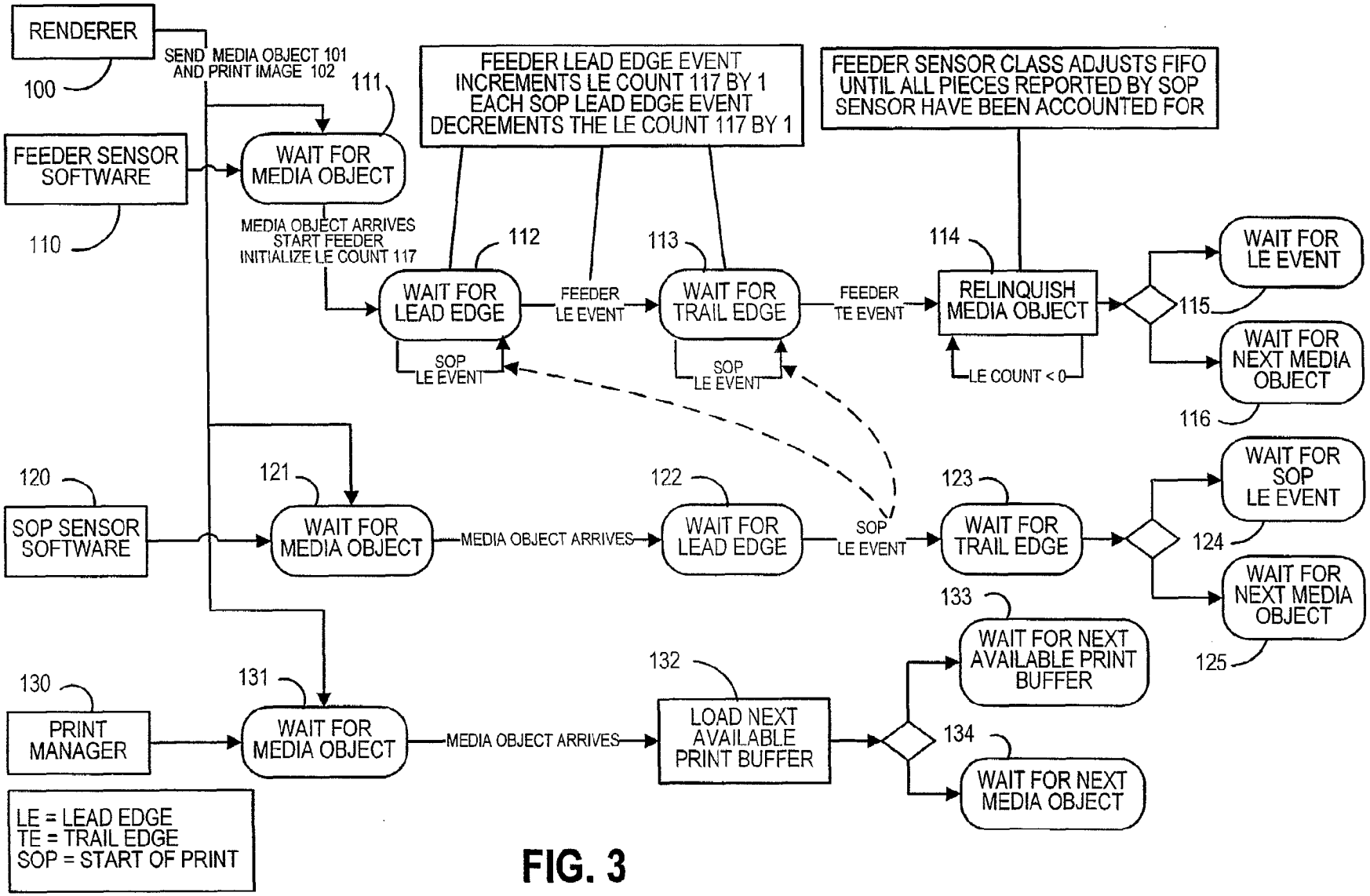
FIG. 3 is a drawing of a flow chart that illustrates the synchronization algorithm contained in processor 25 (FIG. 2) that is used to detect paper feed shingling errors and synchronize a printer and a feeder.

FIG. 3 is a drawing of a flow chart that illustrates the synchronization algorithm contained in processor 25 (FIG. 2) that is used to detect paper feed shingling errors and synchronize a printer and a feeder. To prevent synchronization issues between feeder sensor 13 and start of print sensor 14 the algorithm set fort herein is designed to verify the number of sheets of paper fed using a feedback scheme. This design compares the paper sheet count indicated by lead edge transitions from sensors, feeder sensor 13 and start of print sensor 14.

The typical workflow that detects and corrects for a shingling condition is explained as follows.

In step 100 Renderer generates print images, i.e. a media object 101 and a print image 102 that are sent to steps 111,121 and 131.

Each media object 101 is forwarded to three software components, Feeder Sensor software 110, Start of Print (SOP) Sensor software 120, and the Print Manager 130. Feeder Sensor software 110 and SOP Sensor software 120 cooperatively implement the synchronization algorithm with application processor 25.

The Feeder Sensor software 110 matches each piece of media. i.e., paper 11 and 12 fed from the Feeder 40 with a media tracking data object 101. The Feeder Sensor software 110 is responsible for starting the Feeder Motor 26 when media tracking data objects 101 begin to arrive from the Renderer 100, and for stopping the Feeder Motor 26 when no further media data tracking objects 101 are available.

The SOP Sensor software 120 cooperates with the Feeder Sensor software 110 to synchronize the number of pieces of media fed, i.e., paper 11 and 12 with the number of media data tracking objects 101 sent to the Feeder sensor software 120. It would be obvious to one skilled in the art that this invention will process additional sheets of paper other than paper 11 and 12 and different media tracking objects 101.

The Print Manager 130 synchronizes the physical printing of each image 102 on sheets of paper 11 and 12 with the Printing Mechanism 30.

The Feeder Sensor software 110 waits for and accepts media objects 101 at wait for media object 111 in the order sent from the Renderer 100. When the first media object 101 arrives, the Feeder Sensor software 110 starts the Feeder Motor 26 and initializes a lead edge count 117 of the leading edge of paper 11 and paper 12.

The Feeder Sensor 110 software waits for a lead edge signal 112 for each sheet of paper 11 and 12 fed from Feeder 40 and detected by Feeder Sensor 13. The Feeder Sensor software 110 increments its sheet or lead edge count 117 by 1 count for each lead edge detected.

The Feeder Sensor software 110 is signaled each time a lead edge 122 of sheets of paper 11 and 12 is detected in the vicinity of Transport 41 and reported by the SOP Sensor software 120 to the feeder sensor software 110. The Feeder Sensor software 110 then decrements its lead edge count 117 by 1 count for each SOP lead edge signaled.

The Feeder Sensor software 110 is signaled each time a trail edge 113 of paper 11 and 12 is detected by Feeder 40. When the trail edge of the current sheet of paper 11 or 12 is detected, the Feeder Sensor software 110 releases its control of the media object 101 that was associated with that sheet of paper 11 or 12.

Each time the Feeder Sensor software 110 relinquishes a media object 101, it verifies at 114 that its lead edge has returned to zero. If the lead edge count is negative, then the Feeder Sensor software must account for pieces of media sheets of paper 11 or 12 that were missed due to overlapping lead and trail edges at the Feeder Sensor 13.

At 114, the Feeder Sensor software 110 adjusts its media tracking data object list 101 as needed by relinquishing media objects 101 and incrementing its lead edge count 117 by one count per each additional media object 101 until its lead edge count returns to zero. The next media tracking object 101, if available, is then correctly associated with the next physical piece of media, i.e, paper 12 to be fed at 115.

The SOP Sensor software 120 waits for and accepts media objects 101 at 121 in the order sent from the Renderer 100. This order is the same as the order of media objects sent to both the Feeder Sensor software 110 and the Print Manager 130.

The SOP Sensor software 120 is signaled each time a lead edge 122 is detected in the vicinity of transport 41 by the SOP Sensor 14. The SOP Sensor software signals the Feeder Sensor software 110 each time an SOP lead edge is detected. As mentioned above, the Feeder Sensor software will adjust its lead edge count 117 down by 1 count for each SOP Lead Edge reported to it.

Pieces of paper 11 and/or 12 missed at the Feeder Sensor 13 will be indicated by a negative lead edge count when the trail edge 113 occurs and is reported to the Feeder Sensor software 110, if feeder sensor 13 failed or shingling occurred.

Since complete singulation of media pieces most likely occurs by the time each piece of paper 11 arrives at the SOP Sensor 14, the SOP Sensor software 120 maintains a more accurate count of each piece of paper 11 and/or 12 that travels to and through the vicinity of transport 41. The SOP Sensor 14 verifies that there is one piece of paper 11 and/or 12 present in the vicinity of transport 41 for each print image 102 attached to a given media tracking data object 101.

The Print Manager 130 waits for and accepts media tracking data objects 102 in the order sent from the Renderer 100. As print buffers become available in Printing Mechanism 30, the Print Manager 130 fetches information from the media tracking data object 101 representing the next image 102 to be printed. The Print Mechanism 30 then enables the buffer for printing. The order of the print images 102 is dictated by the order of the media tracking data objects 101. The starting print position is calculated from the SOP lead edge signal 122. At the point at which the starting print position is passing under the print heads, the application has ensured that the print image 101 is properly paired with the piece of paper 11 and/or 12 passing under the print heads in printing mechanism 30.

After the feeder sensor software 110 relinquish each media data tracking object 101 at step 114 it will either wait for the next lead edge event 1 12 at step 115 if its list contains another media data tracking object 116. It then resumes operation at step 113. In the event, its list is empty, i.e., it contains no more media data tracking objects 101, the feeder software 110 will wait for the next media data tracking object 101 at step 116 resuming operation at step 111. After the trail edge 123 is reported to the SOP sensor software 120, the SOP sensor software 120 will wait for the next lead edge 122 at step 124 if its list contains another media data tracking object 101 resuming operation at step 122. In the event its list is empty the SOP sensor software 120 will wait for the next media data tracking object 101 at step 125 resuming operation at step 121.

After the print image 102 is printed on paper 11 or 12 the print manager 130 waits for the next available print buffer in printing mechanism 30 at step 133 only if the print managers 130 list contains another media tracking data object 101 resuming operation at step 132. In the event its list is empty print manager 130 will wait for the next media data tracking object 101 at step 134, resuming operation at step 131.

It would be obvious to one skilled in the art that the algorithm described above does not just apply to a printer. It can be used in a mail finishing or mail creation device. Any machine with a sensor after a feeder can employ this algorithm to synchronize shingled pieces of paper. This would be especially powerful in matched mail applications like Documatch® a product sold by Pitney Bowes Inc. of One Elmcroft Road, Stamford, Conn. where the correct documents inserted into the envelope must match the printing on an envelope, since the documents may be bills, personal records, etc.

This invention is also applicable to sheet feeding, the same concepts will work for any type of material that can shingle.

In addition, the system does not need to be implemented on a single processor. There could be a feeder processor and a printing processor. There would need to be communications between the processors, but the same algorithm could be employed.

Notice that this algorithm can also handle multiple shingle pieces. Instead of two pieces being shingled, it could handle three or more pieces shingled if they manage to separate.

The above specification describes a new and improved method for detecting paper feed shingling errors and synchronizing a printer and a feeder. It is realized that the above description may indicate to those skilled in the art additional ways in which the principles of this invention may be used without departing from the spirit. Therefore, it is intended that this invention be limited only by the scope of the appended claims.

What is claimed is:

1. A method for identifying media that shingles, the method comprising the steps of:

A) sensing a leading edge and a trailing edge of sheets of media as they are moved off a stack;

B) counting the leading edge when the leading edge moves off the stack;

C) sensing the leading edge and trailing edge of the sheets of media when the sheet of media move a distance along a path;

D) counting the leading edge when the leading edge moves the distance along the path;

E) comparing the number of sheets of media sensed when the media moved off of the stack with the number of sheets of media sensed when the media moved the distance along the path to determine if shingling has occurred; and F) verifying that there is one sheet of the media present in a vicinity of a transport for a print image.

2. The method claimed in claim 1, wherein if the comparing step determines that shingling has occurred synchronizing the count of sheets moved off the stack to match the count of sheets moved the distance along the path.

3. The method claimed in claim 2, wherein each of the sheets of media once singulated will be printed correctly.

4. The method claimed in claim 1, wherein if the comparing step determines that the sheets of media singulated correctly as the sheets of media moved off the stack images are printed on the sheets of media.

5. The method claimed in claim 4, wherein the images are printed on the media in a desired order.

6. The method claimed in claim 1, wherein in step A sensing is performed by a feeder sensor.

7. The method claimed in claim 6, wherein if the comparing step determines that a singulation condition is reported due to a failure of the feeder sensor the media will remain on the stack.

8. The method claimed in claim 1, wherein in step C sensing is performed by a start of print sensor.

9. The method claimed in claim 8, wherein the start of print sensor synchronizes a proper image on the sheets of media.

10. A method for identifying media that shingles, the method comprising the steps of:

A) sensing a leading edge and a trailing edge of sheets of media as they are moved off a stack to determine a first count of a number of sheets;

B) sensing, downstream along a feed path from Step (A), the leading edge and the trailing edge of the sheets of media when the sheet of media move a distance along the feed path to determine a second count of a number of sheets;

C) comparing the first count of a number of sheets of media with the second count of a number of sheets of media to determine if shingling has occurred; and D) verifying that there is one sheet of the media present in a vicinity of a transport for a print image.

* * * * *